US012305945B2

(12) United States Patent
Canestrelli

(10) Patent No.: US 12,305,945 B2
(45) Date of Patent: May 20, 2025

(54) HEAT SHIELD AND FIREARM INCLUDING THE SAME

(71) Applicant: Belmonte Alessio Canestrelli, Henderson, NV (US)

(72) Inventor: Belmonte Alessio Canestrelli, Henderson, NV (US)

( * ) Notice: Subject to any disclaimer, the term of this patent is extended or adjusted under 35 U.S.C. 154(b) by 20 days.

(21) Appl. No.: 18/373,458

(22) Filed: Sep. 27, 2023

(65) Prior Publication Data

US 2024/0110760 A1 Apr. 4, 2024

Related U.S. Application Data

(60) Provisional application No. 63/411,532, filed on Sep. 29, 2022.

(51) Int. Cl.
*F41A 21/44* (2006.01)

(52) U.S. Cl.
CPC ..... *F41A 21/44* (2013.01)

(58) Field of Classification Search
CPC ..... F41A 21/44
See application file for complete search history.

(56) References Cited

U.S. PATENT DOCUMENTS 4,601,123 A * 7/1986 Swearengen ..... F41A 11/02 42/74
4,663,875 A * 5/1987 Tatro ..... F41A 13/12 42/71.01
5,303,859 A * 4/1994 Jenkin ..... F41C 23/02 224/664
5,613,316 A * 3/1997 Hightower ..... F41C 23/02 224/150
8,418,393 B1 * 4/2013 Powers ..... F41A 9/72 42/106
8,615,915 B2 * 12/2013 Hunter ..... F41A 19/10 42/72
8,656,621 B2 * 2/2014 Chvala ..... F41A 13/12 42/71.01
8,782,942 B1 * 7/2014 Bentley ..... F41G 1/12 42/71.01
8,819,976 B1 * 9/2014 Kellgren ..... F41A 9/17 42/6
9,103,612 B2 * 8/2015 Foster ..... F41A 11/00
9,121,664 B2 * 9/2015 Fitzpatrick ..... F41C 23/16
9,400,148 B2 * 7/2016 Pittman ..... F41A 9/82
9,612,072 B2 * 4/2017 Hochstrate ..... F41G 1/00
9,897,406 B2 * 2/2018 Oz ..... F41A 11/00
11,009,305 B2 * 5/2021 Akyol ..... F41A 9/72
11,340,029 B2 * 5/2022 Stenzel ..... F41A 35/06
11,716,807 B2 * 8/2023 Aguilar ..... H05K 1/14 42/71.01

(Continued)

*Primary Examiner* — Michelle Clement
(74) *Attorney, Agent, or Firm* — The Powers IP Law Firm

(57) ABSTRACT

A heat shield is for a firearm. The firearm includes a barrel, a magazine tube extending parallel to and being coupled to the barrel, and a magazine tube cap coupled to an end of the magazine tube. The barrel has a barrel ring coupled to the magazine tube. The heat shield includes a perforated shroud, a rear ring provided with the shroud, and a front bracket provided with the shroud. The rear ring and the front bracket are each configured to receive at least one of the barrel and the magazine tube therethrough in order to removably couple the heat shield to the barrel.

20 Claims, 7 Drawing Sheets

(56) References Cited

U.S. PATENT DOCUMENTS

| | | | | |
|---|---|---|---|---|
| 11,796,282 | B1 * | 10/2023 | Ding | F41C 23/16 |
| 12,050,074 | B1 * | 7/2024 | Painter | F41A 21/44 |
| 12,072,163 | B2 * | 8/2024 | Herring | F41C 23/16 |
| 2005/0188594 | A1 * | 9/2005 | Tilby | F41C 23/02 42/90 |
| 2012/0317859 | A1 * | 12/2012 | Brown | F41A 5/28 42/71.01 |
| 2015/0377584 | A1 * | 12/2015 | Chvala | F41C 23/16 42/75.01 |
| 2017/0067708 | A1 * | 3/2017 | Steil | F41A 21/00 |
| 2021/0123699 | A1 * | 4/2021 | Berean | F41C 7/02 |
| 2023/0349658 | A1 * | 11/2023 | Gomez | F41A 21/00 |
| 2023/0400275 | A1 * | 12/2023 | Puha | F41A 21/325 |
| 2024/0255252 | A1 * | 8/2024 | Farris | F41C 23/16 |

* cited by examiner

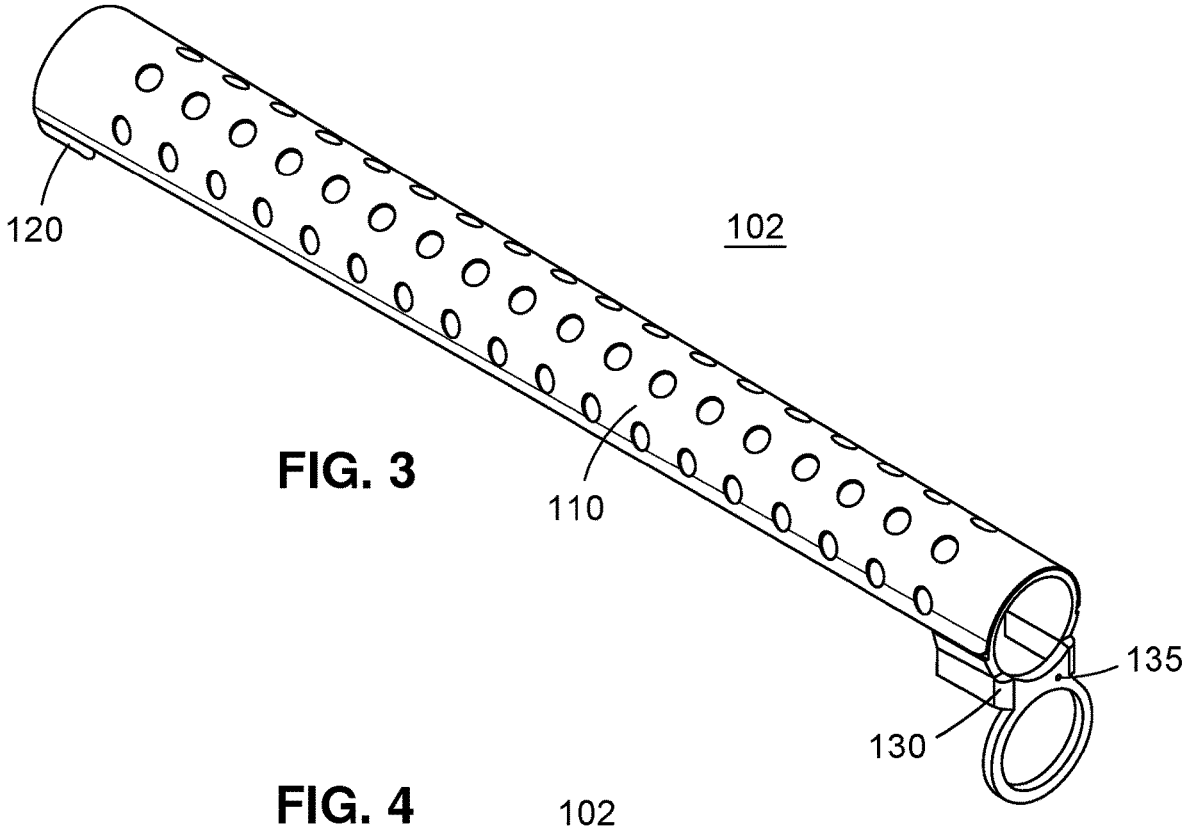
FIG. 3
FIG. 4
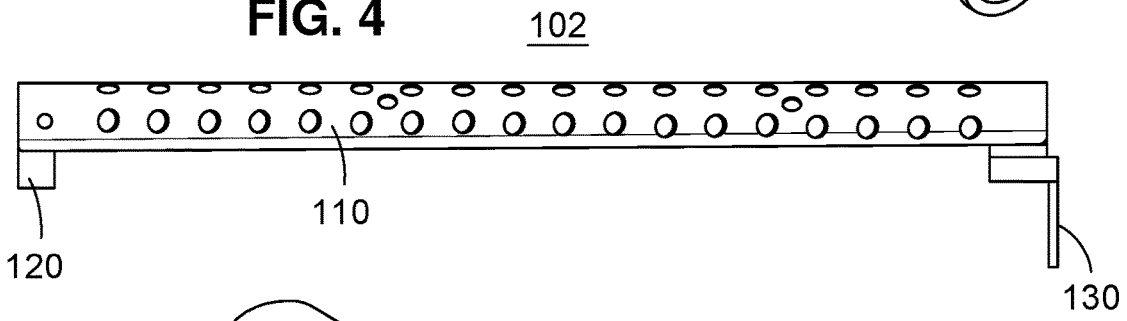
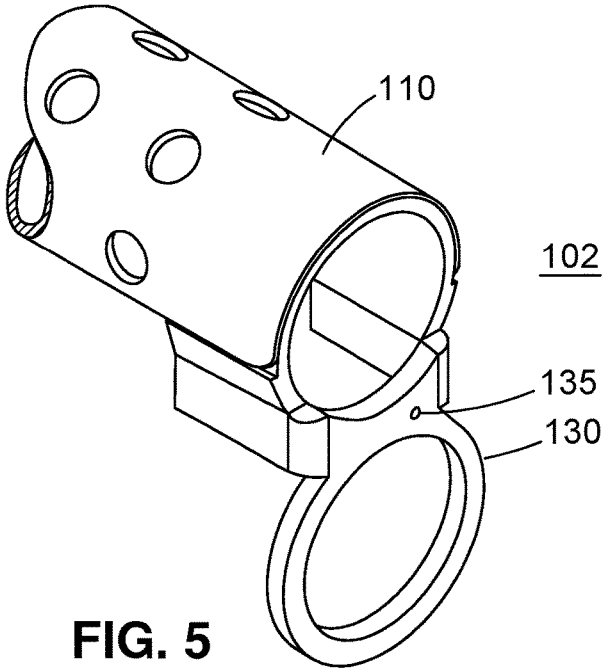
FIG. 5

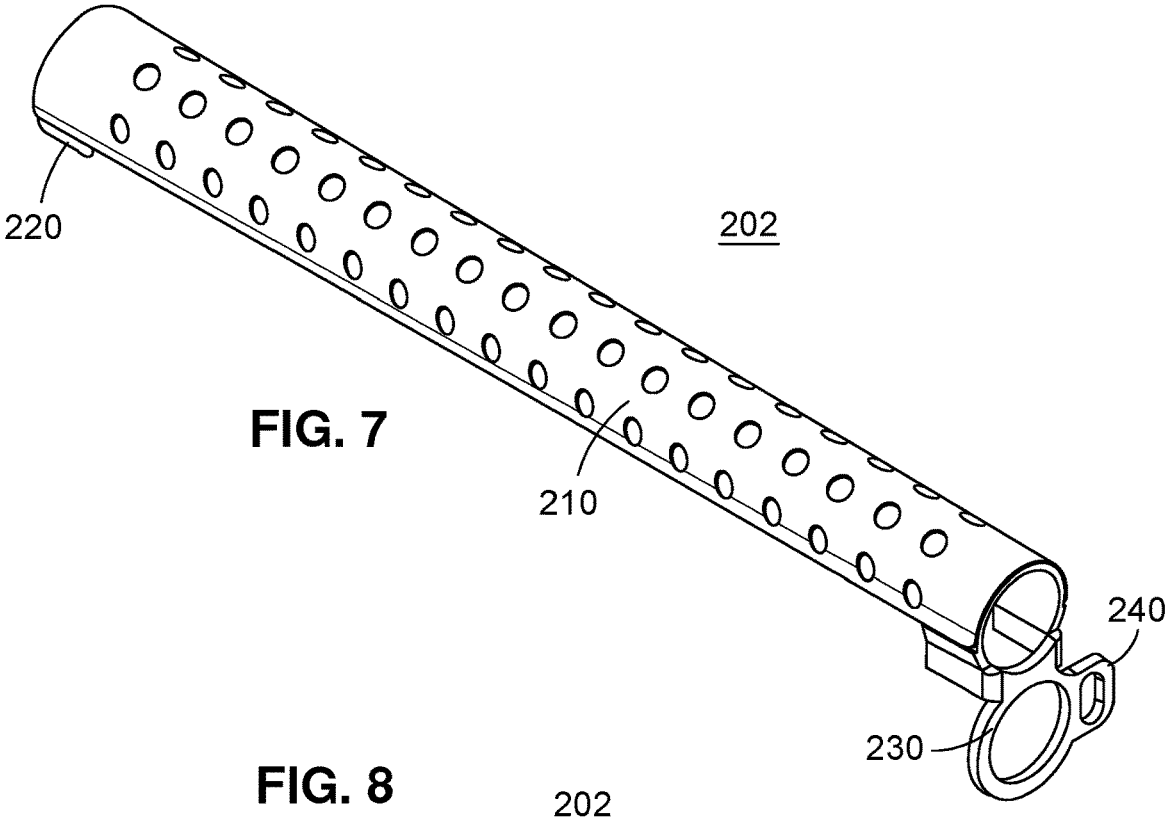
FIG. 7
FIG. 8
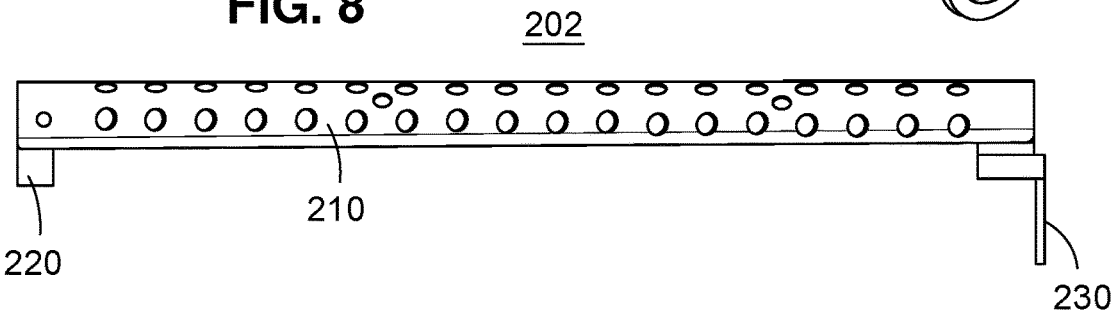
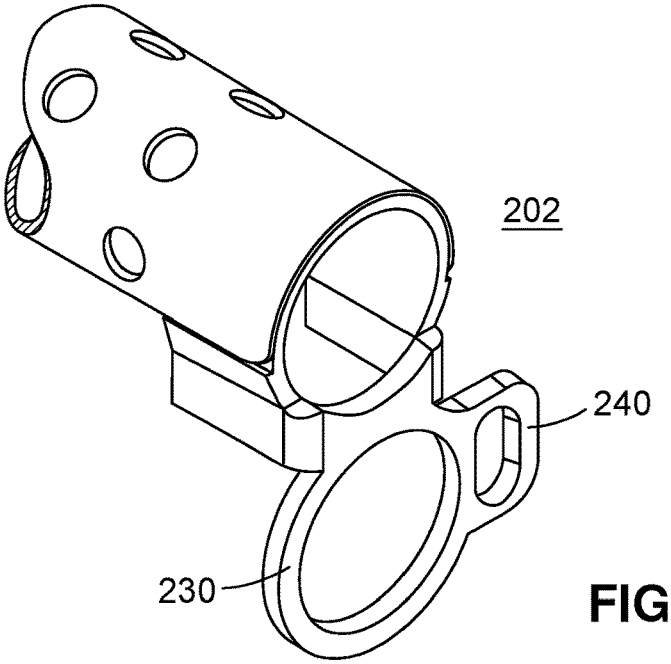
FIG. 9

HEAT SHIELD AND FIREARM INCLUDING THE SAME

CROSS-REFERENCE TO RELATED APPLICATION

The application claims priority to and claims the benefit of U.S. Provisional Patent Application Ser. No. 63/411,532, filed Sep. 29, 2022, the contents of which are incorporated herein by reference in their entirety.

FIELD OF THE INVENTION

The present invention relates to firearms, and more particularly, to heat shields for firearms.

BACKGROUND OF THE INVENTION

Firearms, such as shotguns, short-barreled shotguns, AOW's, and firearms that fire shot-shells/shot-gun shells, are well known. FIG. 1 shows an isometric view of a prior art firearm (e.g., twelve-gauge firearm 2). As shown, the twelve-gauge firearm 2 includes a receiver 9, a trigger group assembly 10, a bolt assembly 11, a trigger guard 12, a magazine tube 13, a forearm 14, a lifter 15, a magazine tube cap 18 coupled to the magazine tube 13, and a barrel 20. The barrel 20 has an integrally formed barrel ring 16. In operation, firearms are known to give off significant amounts of heat. In order to provide a barrier to prevent users from getting burned some firearms have heat shields (e.g., the heat shields are configured to be disposed between the relatively hot barrels of the firearm and the users hand).

For example, the twelve-gauge firearm 2 is provided with a semicircular-shaped heat shield 22 that is welded to the barrel 20. Heat shields such as the heat shield 22 are undesirable for a number of reasons. First, if a user desires to clean around the barrel 20 (e.g., between the barrel 20 and the heat shield 22), they are prevented from doing so because the heat shield 22 is welded (e.g., fixedly connected) to the barrel 20. Second, if a user desires to operate the twelve-gauge firearm 2 without the heat shield 22, they are prevented from doing so because the heat shield 22 is fixedly connected to the barrel 20. Additionally, while some firearms provide for removable heat shields, known and existing heat shields have brackets that require set-screws and in some cases spacers are used (e.g., made of plastic) in order to prevent the heat shields from moving around. One type is made to use the bracket and set screws (and spacer) in the area behind the barrel ring to secure the heat shield to the barrel. As such, these heat shields are only configured to be employed with certain types of firearms, as the additional hardware is not suitable for other firearms. More specifically, these heat shields are not suitable for firearms including the Shockwave, the 590M Shockwave, the Tac-14, the Standard Remington 870, or others with a similar length magazine tube. The Shockwave, the 590M Shockwave, the Tac-14, the standard Remington 870, and others with a similar length magazine tube have a barrel ring situated so closely to the forearm/forearm nut that the limited space will not allow the use of such types of heat shields. Another type situates the bracket and set screws in front of the barrel ring to the point of being in front of the magazine cap. This type depends solely on the bracket and set screws to secure the heat shield to the barrel. This design has no secondary measure (spacer) to prevent the heat shield from creeping/moving.

It is with respect to these and other considerations that the disclosure made herein is presented.

SUMMARY OF THE INVENTION

One aspect of the invention is directed to a heat shield for a firearm. The firearm includes a barrel, a magazine tube extending parallel to and being coupled to the barrel, and a magazine tube cap coupled to an end of the magazine tube. The barrel has a barrel ring coupled to the magazine tube. The heat shield includes a perforated shroud, a rear ring provided with the shroud, and a front bracket provided with the shroud. The rear ring and the front bracket are each configured to receive at least one of the barrel and the magazine tube therethrough in order to removably couple the heat shield to the barrel.

Another aspect of the invention is directed to a firearm including the aforementioned heat shield.

Further objects, features, and advantages of the present invention over the prior art will become apparent from the detailed description of the drawings which follows, when considered with the attached figures.

DESCRIPTION OF THE DRAWINGS

FIGS. 3 and 4 are isometric and side views, respectively, of a heat shield for the firearm of FIG. 2A.

FIG. 5 is an enlarged view of a portion of the heat shield of FIG. 3.

FIGS. 7 and 8 are isometric and side views, respectively, of another heat shield, in accordance with another non-limiting embodiment of the disclosed concept.

FIG. 9 is an enlarged view of a portion of the heat shield of FIG. 7.

DETAILED DESCRIPTION OF THE INVENTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The description of elements in each figure may refer to elements of proceeding figures. Like numbers refer to like elements in all figures, including alternate embodiments of like elements.

As employed herein, the term "coupled" shall mean connected together either directly or indirectly through one or more intermediate parts or components.

Figure 2A:
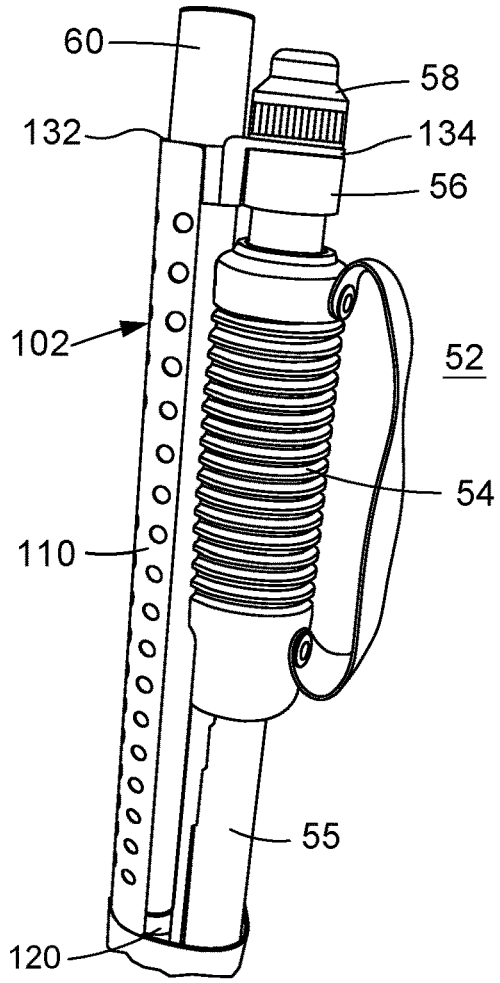
FIG. 2A is an isometric view of a portion of a firearm, in accordance with one non-limiting embodiment of the disclosed concept.

FIG. 2A shows an isometric view of a firearm, in accordance with one non-limiting embodiment of the disclosed concept. The firearm of FIG. 2A is depicted as being a shotgun 52, but it will be appreciated that the firearm may also be a short-barreled shotgun, an AOW, or a firearm that fires shot-shells or shotgun shells. As shown, the shotgun 52 includes a forearm assembly 54, a magazine tube 55 extending through the forearm assembly 54, a magazine tube cap 58 coupled to an end of the magazine tube 55, and a barrel 60. The magazine tube extends parallel to and is coupled to the barrel 60. The barrel 60 has an integrally formed barrel ring 56 coupled to the magazine tube 55. The barrel 60 extends parallel to the forearm assembly 54 and the magazine tube 55. Located inside the magazine tube 55 are a spring and a follower (not shown). It will also be appreciated that forearm assembly 54 is comprised of a slide tube, a forearm component, and a nut for the slide tube. Additionally, as shown in FIG. 2A, and as will be discussed in greater detail below, the shotgun 52 includes a heat shield 102 coupled to the barrel 60.

Figure 2B:
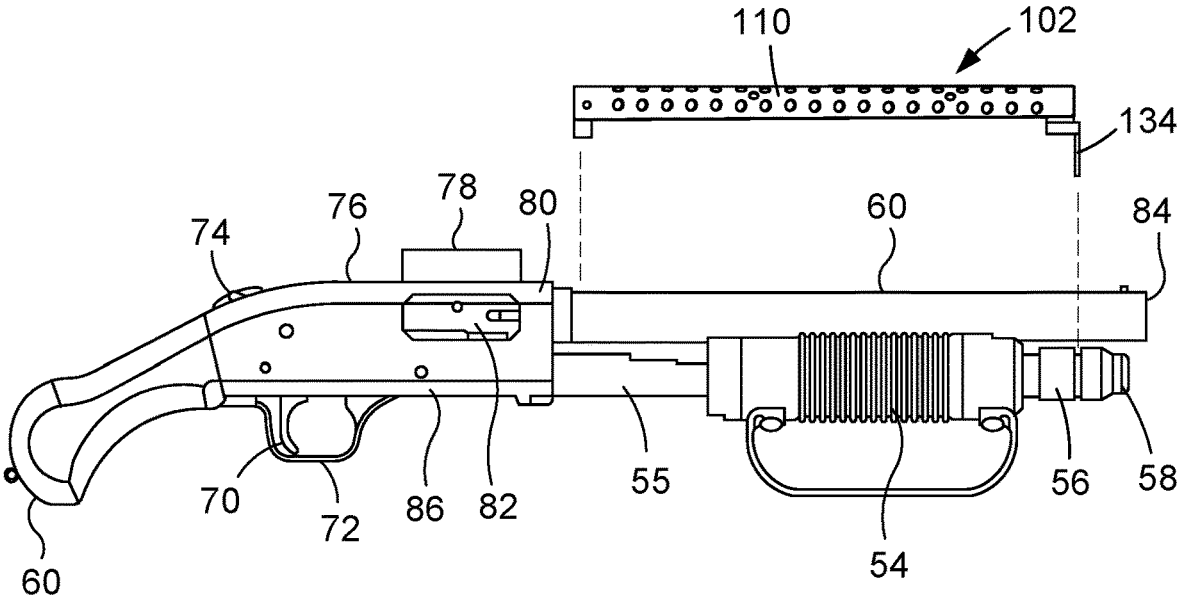
FIG. 2B shows a right side view of the firearm of FIG. 2A, and shown with the heat shield exploded.

FIG. 2B shows a view of the shotgun 52 with the heat shield 102 in phantom line drawing. As shown, the shotgun 52 further has a trigger group assembly 70, a trigger guard 72, a safety button 74, a receiver 76, an ejection port 78, a chamber 80, a bolt 82, a muzzle 84 located at the end of the barrel 60, and a lifter 86. It will, however, be appreciated that the heat shield 102 is configured to be employed with firearms other than the shotgun 52.

More specifically, it will be appreciated that the heat shield 102 is also configured to be employed with short-barreled shotguns and firearms that fire shot-shells/shot-gun shells. Additionally, the heat shield 102 is designed to fit the Mossberg "Shockwave" firearm, all Mossberg firearms with a magazine tube that is the same length as the magazine tube 55, the Remington Tac-14 firearm, and all Remington 870 firearms with a standard magazine tube length. However, the principles of the invention may be applied to create heat shields which are configured to fit other firearms, such as those of other manufacturers. Aspects of the heat shield 102, and advantages afforded to the shotgun 52 by incorporation of the heat shield 102, will be discussed below.

FIGS. 3 and 4 show different views of the heat shield 102, and FIG. 5 shows an enlarged view of a portion of the heat shield 102. It will be appreciated that the heat shield 102 is comprised of three segments. Specifically, the heat shield 102 includes a shroud 110, which shroud preferably comprises an elongated and partially tubular-shaped body which includes one or more perforations or other heat transmitting or venting features, and one or more means for removably mounting the heat shield 102 to a firearm. This means may comprise, for example, a partially circular-shaped (e.g., an arc with ends that are spaced apart from each other) rear ring 120 (e.g., or mount, clip, etc.) provided with (e.g., without limitation, welded to and/or fixedly attached to) a first end of the shroud 110, and a front bracket 130 provided with (e.g., without limitation, welded to and/or fixedly attached to) a second, opposite end of the shroud 110. These three components 110,120,130 may be fixedly attached to each other, such as, for example, being spot welded together so as to form a unitary component. Additionally, in another example a rear ring and front bracket may be provided with middle portions of a shroud, without departing from the scope of the disclosed concept.

Figure 6A:
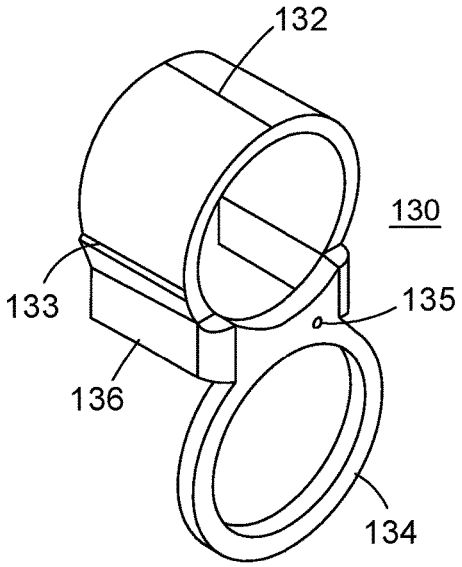
FIGS. 6A-6F are different views of a front bracket for the heat shield of FIGS. 3-5.
Figure 6B:
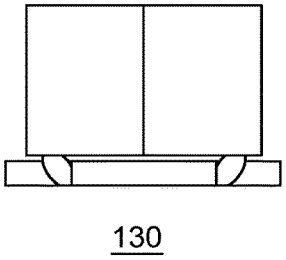
Figure 6C:
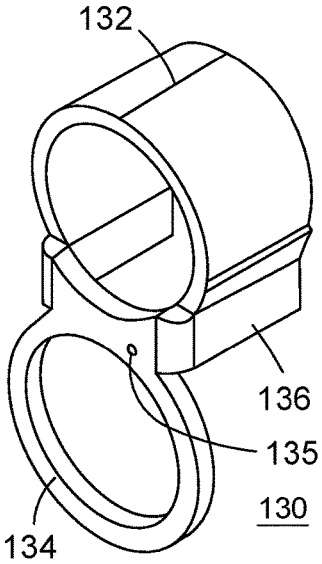
Figure 6D:
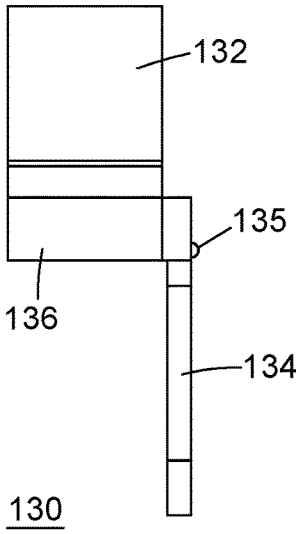
Figure 6E:
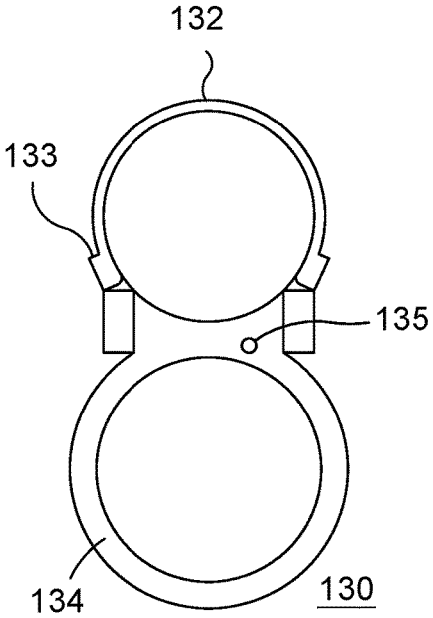
Figure 6F:
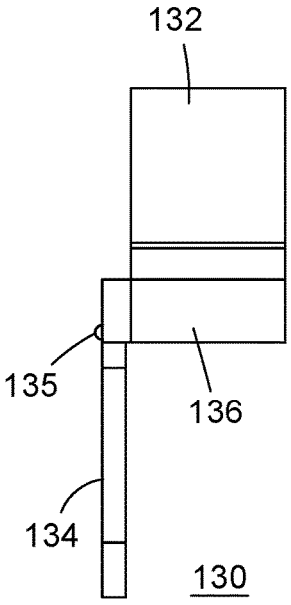

FIGS. 6A-6F show different views of the front bracket 130 for the heat shield 102. As shown, the front bracket 130 includes a first receiving portion 132 configured to receive the barrel 60 therethrough, an annular-shaped second receiving portion 134 configured to receive the magazine tube 55 therethrough and disposed generally perpendicular to the first receiving portion 132, and a mounting portion 136 extending between the receiving portions 132,134. In one example, as shown in FIGS. 6A and 6E, the first receiving portion 132 has a pair of outwardly extending tab elements (only one tab element 133 is labeled for ease of illustration), that assist with aligning the shroud 110 during manufacture of the heat shield 102. Moreover, in another example, first and second receiving portions of a front bracket may be hingedly connected such that one of these elements could be opened and closed around either or both of the barrel and the magazine tube. Additionally, in operation, the novel front bracket 130 and the rear ring 120 advantageously allow the heat shield to be removably coupled to the shotgun 52.

More specifically, and referring again to FIG. 2A, as shown, the rear ring 120 and the first receiving portion 132 are each slidably coupled to the barrel 60. As such, it will be appreciated that the heat shield 102 is able to be installed on, and removed from, the barrel 60 via the rear ring 120 and the first receiving portion 132. For example, during installation, the barrel 60 can be extended through the rear ring (e.g., although it is only partially circular-shaped in order to allow the heat shield 102 to be slidably coupled the barrel 60, it is structured to maintain engagement with the barrel 60), and when the shroud 110 is nearly fully disposed on the barrel 60, the first receiving portion 132 can be extended onto to the barrel 60 in order to provide for a relatively secure engagement between the barrel 60 and the heat shield 102. Accordingly, in one example the rear ring 120 and the front bracket 130 are each configured to receive at least one of the barrel 60 and the magazine tube 55 therethrough in order to removably couple the heat shield 102 to the barrel 60.

Continuing to refer to FIG. 2A, it will also be appreciated that the rear ring 120 and the first receiving portion 132 have a common central axis, and the second receiving portion 134 has a central axis offset from the common central axis of the rear ring and the first receiving portion. In this manner, the rear ring 120 and the first receiving portion 132 can function to couple the heat shield 102 to the barrel 60. Furthermore, the second receiving portion 134 advantageously functions to couple the heat shield 102 to the magazine tube 55, and thus stabilize the heat shield 102 on the shotgun 52. More specifically, during installation of the heat shield 102, the magazine tube cap 58 may be removed from the shotgun 52, and the magazine tube 55 may be extended through the second receiving portion 134. Additionally, as shown in FIG. 6A, the second receiving portion 134 has a mating member (e.g., detent 135) extending outwardly from a surface. It will be appreciated that the magazine tube cap 58 has a mating member (e.g., a recess) configured to receive the detent 135 (e.g., or extend into a recess of the second receiving portion, not shown) and thus prevent the magazine tube cap 58 from rotating with respect to the second receiving portion 134 (e.g., the detent 135 and recess assist with maintaining the engagement between the second receiving portion 134 and the magazine tube cap 58 so that magazine tube cap 58 is not unintentionally unscrewed). It will also be appreciated that a suitable alternative second receiving portion could have a recess and a suitable alternative magazine tube cap, not shown, could have a corresponding detent, without departing from the scope of the disclosed concept.

Once the second receiving portion 134 has been positioned with the magazine tube 55 extending therethrough, the magazine tube cap 58 can once again be coupled to an end of the magazine tube 55, and the shotgun 52 can be fit for usage. In one example, the second receiving portion 134 has an inner diameter, and the magazine tube cap 58 has an outer diameter greater than the inner diameter of the second receiving portion 134 in order to prevent the heat shield 102 from sliding off of the magazine tube 55.

Figure 1:
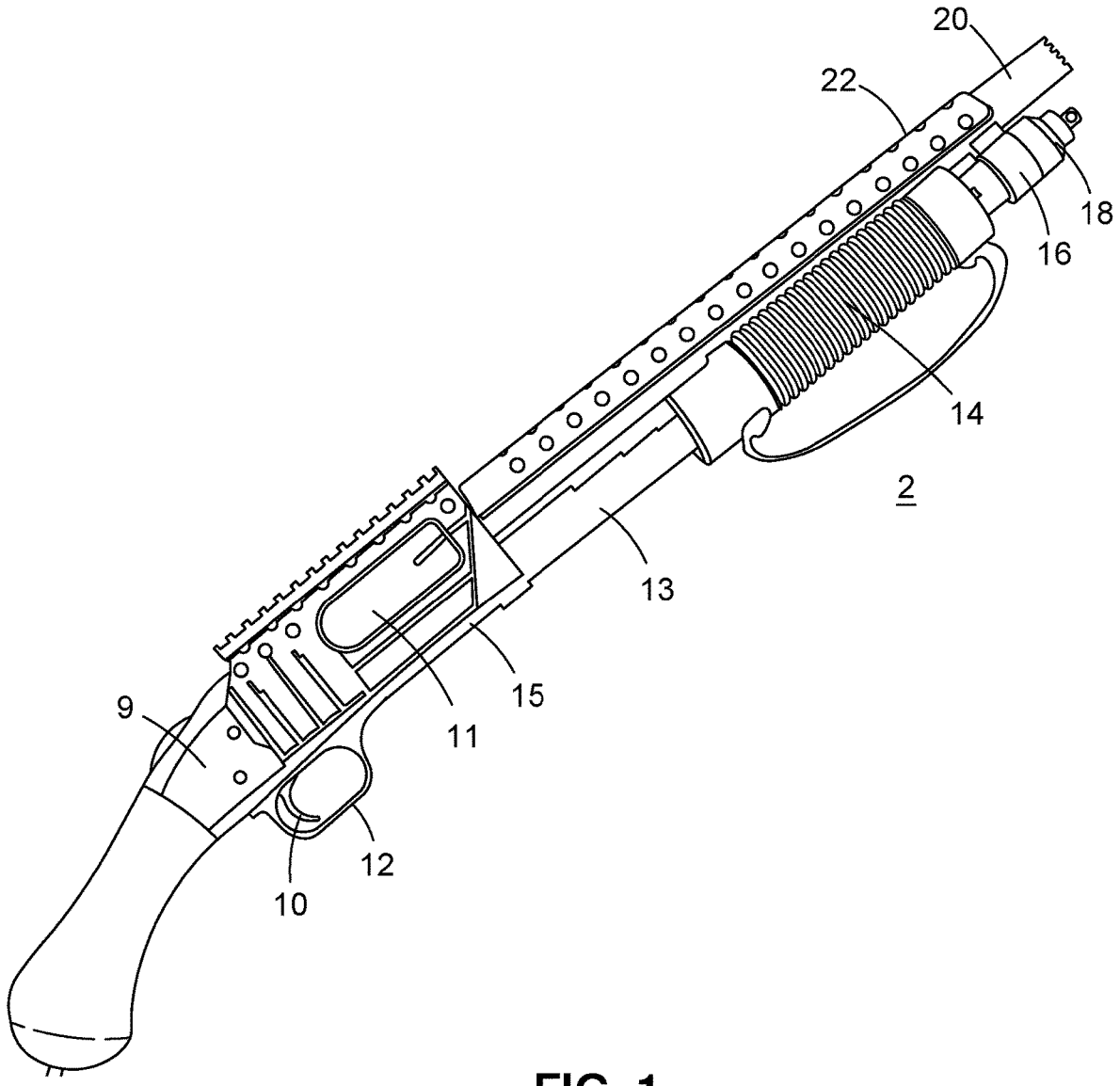
FIG. 1 (PRIOR ART)
FIG. 1 is an isometric view of a prior art firearm.

Accordingly, due to the removable nature of the heat shield 102, the shotgun 52 can be cleaned in a much more effective manner, as compared to the prior art shotgun 2 (FIG. 1). Specifically, all a user needs to do is remove the magazine tube cap 58, slide the heat shield 102 off of the magazine tube 55 and the barrel 60, so that the first and second receiving portions 132,134 slide off of the barrel 60 and magazine tube 55, respectively. Furthermore, upon additional sliding, the rear ring 120 is configured to slide off of the barrel 60 and easily allow a user to clean the shotgun 60. In another example, the rear ring 120 is a spring clip that is configured to flex outwardly and inwardly when be pressed onto the barrel 60. It will likewise be appreciated that if a user desires to use the shotgun 52 without the heat shield 102, this can easily be accomplished due to the removable nature of the heat shield 102. Compare, for example, to the prior art shotgun 2 of FIG. 1, in which the heat shield 22 is fixedly attached to the barrel 20.

Continuing to refer to FIG. 2A, the construction of the heat shield 102 advantageously allows it to removably couple to the shotgun 52 without any modification needed to the shotgun 52. Specifically, as shown in FIG. 2A, the second receiving portion 134 is positioned between (e.g., press fit between) the barrel ring 56 and the magazine tube cap 58. By utilizing the existing geometry of the shotgun 52, the heat shield 102 is able to be mounted to the barrel 60 and the magazine tube 55 in a unique and unobtrusive manner. Stated differently, the existing space between the barrel ring 56 and the magazine tube cap 58 is able to be utilized by the second receiving portion, which is preferably disposed therebetween in a press fit manner in order to lock the heat shield 102 in place. Accordingly, the heat shield 102 advantageously fits where other heat shields (e.g., heat shields coupled to barrels with set screws and/or spacers) will not. That is, the heat shield 102 is configured to be removably coupled to the barrel 60 without any intermediate parts or components (e.g., without set screws or spacers).

FIGS. 7-9 show different views of another heat shield 202 for the shotgun 52 (FIG. 2A). The heat shield 202 is structured similar to the heat shield 102 (e.g., has shroud 210, rear ring 220, and a front bracket 230). However, extending from the second receiving portion of the front bracket 230 is a mounting portion 240 having a through hole. The mounting portion 240 is advantageously configured to allow a user to mount a sling (not shown) to the front bracket 230, thereby adding additional capability to the shotgun.

Figure 10:
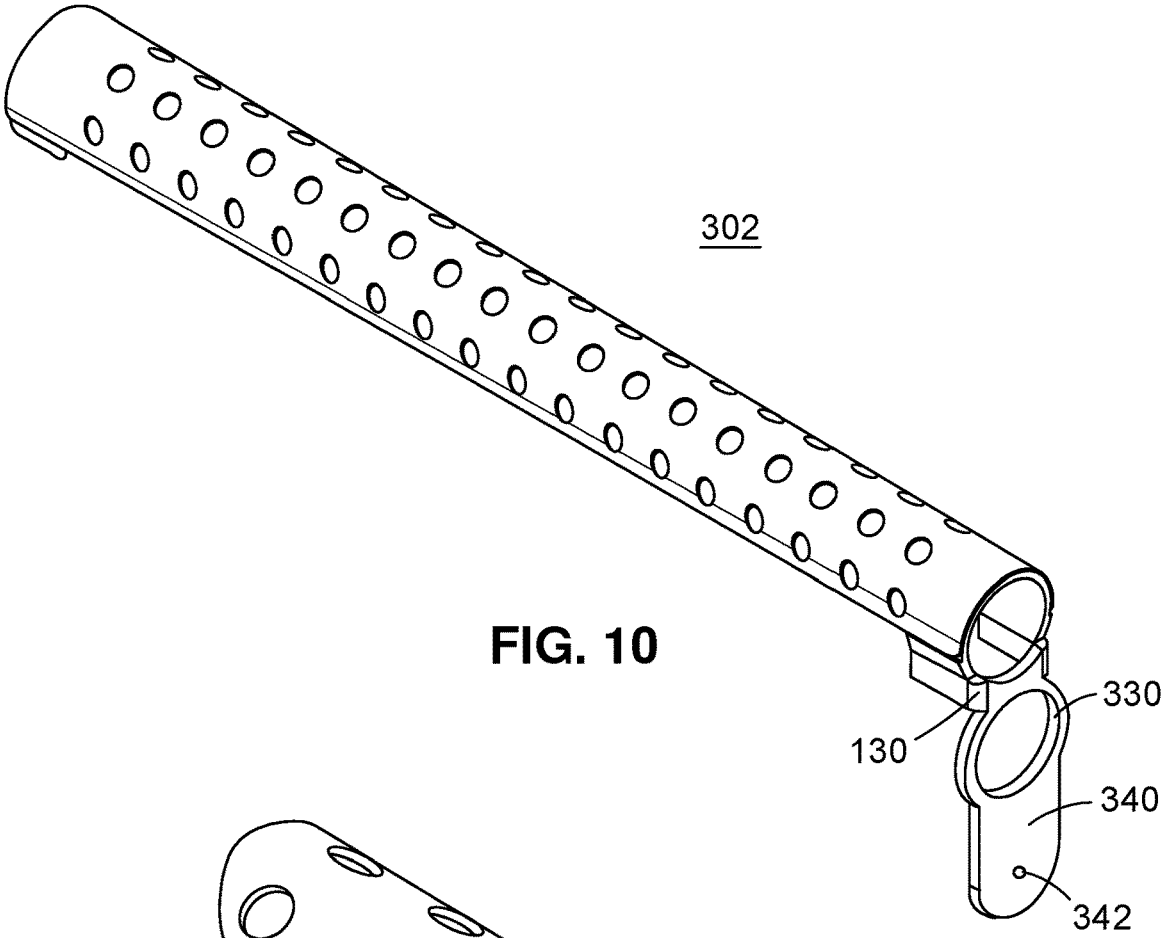
FIG. 10 is an isometric view of another heat shield, in accordance with another non-limiting embodiment of the disclosed concept.
Figure 11:
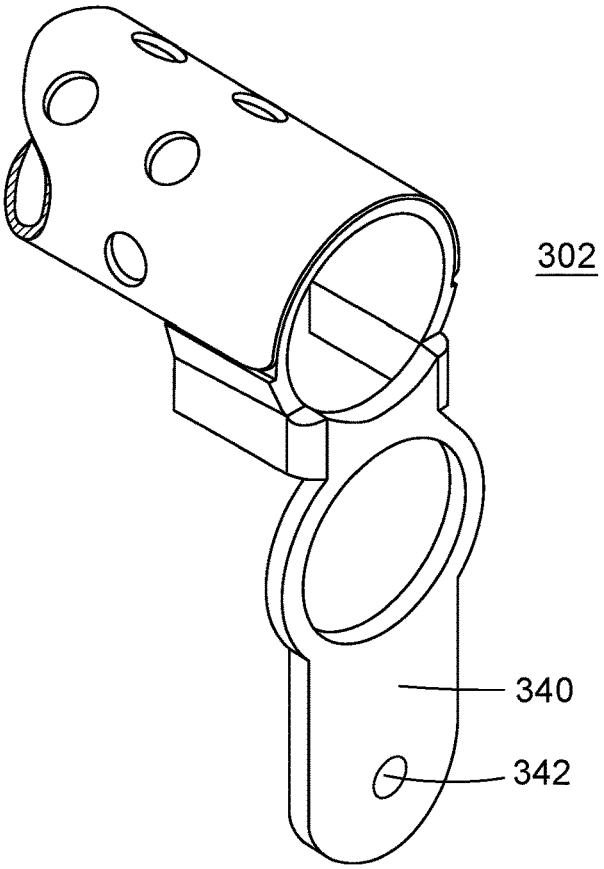
FIG. 11 is an enlarged view of a portion of the heat shield of FIG. 10.

FIGS. 10 and 11 show isometric and enlarged views, respectively, of another heat shield 302 similar to the heat shields 102,202, in accordance with another non-limiting embodiment of the disclosed concept. As shown, the front bracket 330 has a hand guard tab 340 extending from the second receiving portion away from the first receiving portion. The hand guard tab 340 is advantageously configured to prevent a user's hand from slipping off of the shotgun's pump and going in front of the barrel. Additionally, as shown in FIGS. 10 and 11, the hand guard tab 340 has a through hole 342 that is advantageously configured to allow a user to mount a sling (not shown) to the front bracket 330.

Figure 12:
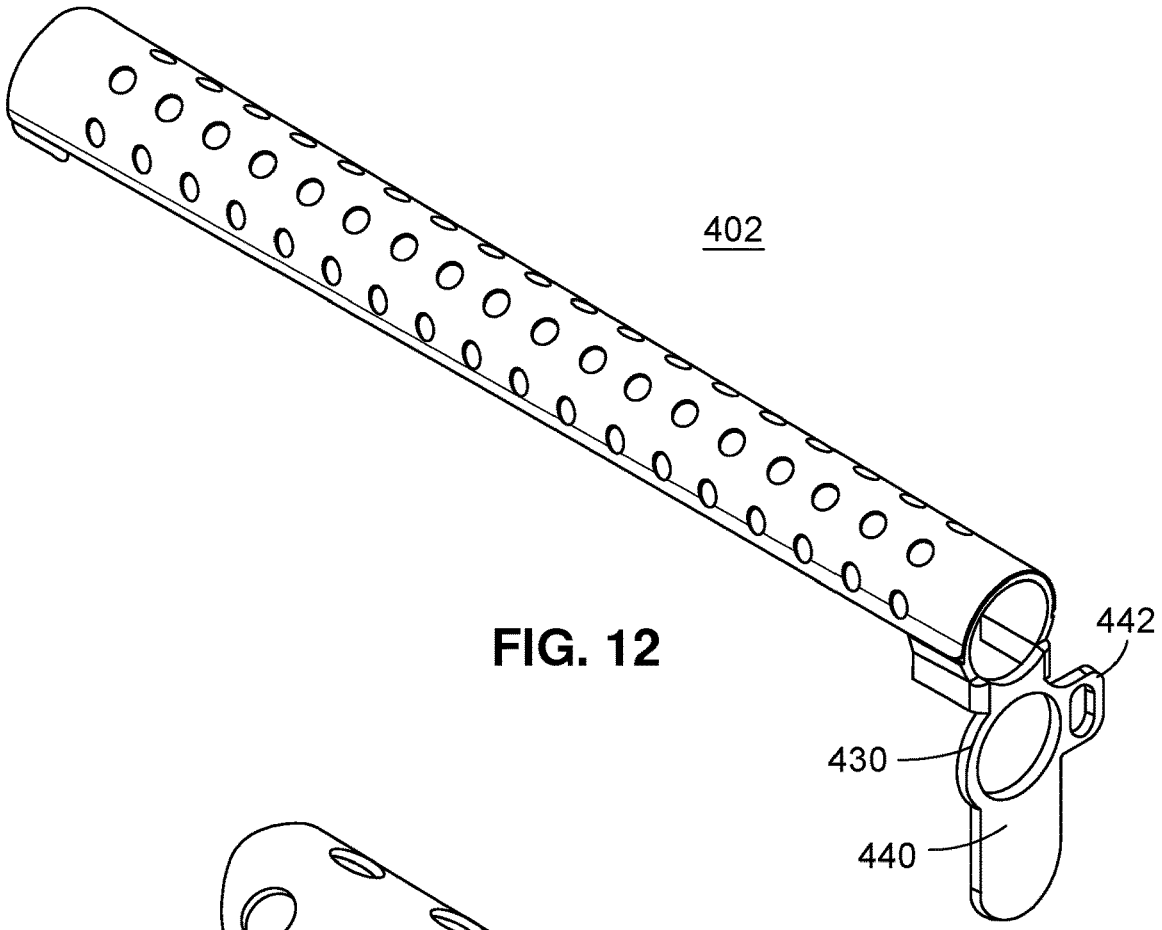
FIG. 12 is an isometric view of another heat shield, in accordance with another non-limiting embodiment of the disclosed concept.
Figure 13:
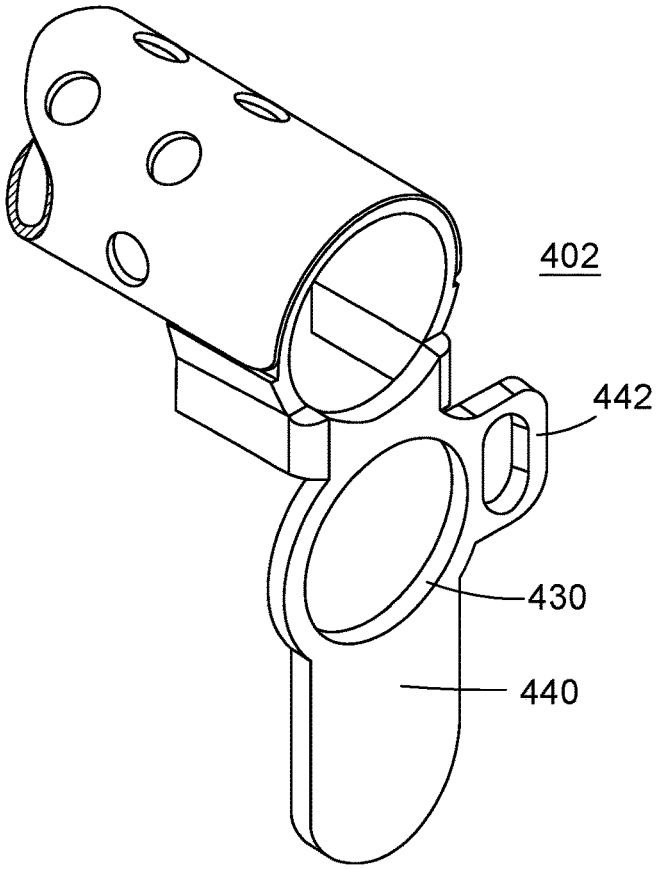
FIG. 13 is an enlarged view of a portion of the heat shield of FIG. 12.

FIGS. 12 and 13 show isometric and enlarged views, respectively, of another heat shield 402 similar to the heat shields 102,202,302 in accordance with another non-limiting embodiment of the disclosed concept. As shown, extending from the second receiving portion of the front bracket 430 are a hand guard tab 440 and a mounting portion 442 for a sling (not shown). As such, it will be appreciated that multiple different configurations of the front bracket are contemplated herein.

It will be appreciated that the means for removably connecting or coupling might have yet other configurations. For example, while the rear ring 120 and/or front bracket 130 may be ring or generally ring shaped, they might have the configuration of two-sided spring clip or other type of connector. Further, while the rear ring 120 and front bracket 130 might be formed with the shroud or be permanently coupled thereto, they might be connectable and disconnectable from the shroud (e.g., be removably coupled). For example, to facilitate coupling of the head shield to different firearms, the front bracket 130 might be disconnectable, such as with threaded fasteners, thus allowing it to be removed and replaced.

Accordingly, it will be appreciated that the disclosed concept provides for an improved (e.g., easier to clean and protect against heat) heat shield 102,202,302,402 and firearm (e.g., shotgun 52) including the same, in which a rear ring and front bracket of the heat shield 102,202,302,402 advantageously removably couple the heat shield 102,202, 302,402 to the magazine tube 55 and barrel 60 of the firearm (e.g., shotgun 52).

Additionally, installing the heat shield 102 on the shotgun 52 may include first removing the magazine tube cap 58 from the forearm assembly 54, and then removing the barrel 60 and associated barrel ring 56 from the shotgun 52. Next, a bead sight (shown but not labeled) may be unscrewed from the barrel 60. Next, the heat shield 102 may be coupled, e.g., slid, onto the barrel 60. With the heat shield 102 in position, the barrel 60 and the heat shield 102 can be slid back onto the shotgun 52. Finally, the magazine tube cap 58 and the bead sight can be re-coupled to the forearm assembly 54 and barrel 60, respectively, and the shotgun 52 is ready for use.

This description uses examples to describe embodiments of the disclosure and also to enable any person skilled in the art to practice the embodiments, including making and using any devices or systems and performing any incorporated methods. The patentable scope of the disclosure is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A heat shield for a firearm, the firearm comprising a barrel, a magazine tube extending parallel to and being coupled to the barrel, and a magazine tube cap coupled to an end of the magazine tube, the barrel having a barrel ring coupled to the magazine tube, the heat shield comprising:

a perforated shroud;

a rear ring provided with the shroud; and a front bracket provided with the shroud, wherein the rear ring and the front bracket are each configured to receive at least one of the barrel and the magazine tube therethrough in order to removably couple the heat shield to the barrel without an intermediate set screw.

2. The heat shield according to claim 1, wherein the shroud has a first end and a second end disposed opposite the first end, wherein the rear ring is provided with the first end, and wherein the front bracket is provided with the second end.

3. The heat shield according to claim 1, wherein the front bracket comprises a first receiving portion and a second receiving portion each configured to receive a corresponding one of the barrel and the magazine tube therethrough, and wherein the front bracket is a unitary, one-piece component.

4. The heat shield according to claim 3, wherein the rear ring and the front bracket are each fixedly attached to the shroud.

5. The heat shield according to claim 3, wherein the rear ring and the front bracket are each removably coupled to the shroud.

6. The heat shield according to claim 3, wherein the front bracket further comprises a first mounting portion and a second mounting portion each disposed between the first and second receiving portions, and wherein the barrel ring is configured to be disposed between the first and second mounting portions.

7. The heat shield according to claim 3, wherein the rear ring is partially circular-shaped in order to allow the heat shield to be slidably coupled the barrel.

8. The heat shield according to claim 3, wherein the rear ring and the first receiving portion have a common central axis, wherein the second receiving portion has a central axis offset from the common central axis of the rear ring and the first receiving portion, and wherein the first receiving portion extends from the second receiving portion such that the first and second receiving portions define two spaced apart thru holes for receiving the barrel and the magazine tube, respectively.

9. The heat shield according to claim 3, wherein the front bracket further comprises a mounting portion extending from the second receiving portion, and wherein the mounting portion has a though hole in order to allow a sling to be mounted to the front bracket.

10. The heat shield according to claim 9, wherein the front bracket further comprises a hand guard tab extending from the second receiving portion away from the first receiving portion.

11. The heat shield according to claim 3, wherein the front bracket further comprises a hand guard tab extending from the second receiving portion away from the first receiving portion, and wherein the hand guard tab has a through hole in order to a sling to be mounted to the front bracket.

12. A firearm comprising:

a magazine tube;

a barrel comprising a barrel ring coupled to the magazine tube;

a magazine tube cap coupled to the magazine tube; and a heat shield comprising:

a perforated shroud, a rear ring provided with the shroud, and a front bracket provided with the shroud, wherein the rear ring and the front bracket are each configured to receive at least one of the barrel and the magazine tube therethrough in order to removably couple the heat shield to the barrel without an intermediate set screw.

13. The firearm according to claim 12, wherein the shroud has a first end and a second end disposed opposite the first end, wherein the rear ring is provided with the first end, wherein the front bracket is provided with the second end, and wherein the front bracket comprises a first receiving portion and a second receiving portion each configured to receive a corresponding one of the barrel and the magazine tube therethrough.

14. The firearm according to claim 13, wherein the second receiving portion is disposed between the barrel ring and the magazine tube cap, wherein the front bracket further comprises a first mounting portion and a second mounting portion each disposed between the first and second receiving portions, and wherein the barrel ring is configured to be disposed between the first and second mounting portions.

15. The firearm according to claim 13, wherein the second receiving portion is press fit between the barrel ring and the magazine tube cap.

16. The firearm according to claim 13, wherein the second receiving portion and the magazine tube have a common central axis extending therethrough, wherein the second receiving portion comprises a surface having a first mating member, and wherein the magazine tube cap has a surface having a second mating member configured to extend into or receive the first mating member in order to prevent the magazine tube cap from rotating with respect to the second receiving portion.

17. The firearm according to claim 13, wherein the rear ring is partially circular-shaped in order to allow the heat shield to be slidably coupled to the barrel.

18. The firearm according to claim 13, wherein the second receiving portion has an inner diameter, and wherein the magazine tube cap has an outer diameter greater than the inner diameter of the second receiving portion in order to prevent the heat shield from sliding off of the magazine tube.

19. The firearm according to claim 12, wherein the heat shield is removably coupled to the barrel without any intermediate parts or components.

20. The firearm according to claim 12, wherein the firearm is a shotgun, a short-barreled shotgun, an AOW, or a firearm that fires shot-shells or shotgun shells.

* * * * *